US010053819B2

(12) United States Patent
Lewis et al.

(10) Patent No.: US 10,053,819 B2
(45) Date of Patent: Aug. 21, 2018

(54) RAIL ALIGNMENT TOOL

(71) Applicants: Ronald Lewis, Cuba, MO (US); Ray Lewis, Cuba, MO (US)

(72) Inventors: Ronald Lewis, Cuba, MO (US); Ray Lewis, Cuba, MO (US)

( * ) Notice: Subject to any disclaimer, the term of this patent is extended or adjusted under 35 U.S.C. 154(b) by 111 days.

(21) Appl. No.: 15/247,642

(22) Filed: Aug. 25, 2016

(65) Prior Publication Data

US 2018/0058015 A1 Mar. 1, 2018

(51) Int. Cl.
*E01B 29/46* (2006.01)
*E01B 29/20* (2006.01)

(52) U.S. Cl.
CPC ..... *E01B 29/46* (2013.01); *E01B 29/20* (2013.01)

(58) Field of Classification Search
CPC ..... E01B 29/16; E01B 29/20; E01B 29/46
USPC ..... 33/651, 651.1
See application file for complete search history.

(56) References Cited

U.S. PATENT DOCUMENTS 909,225 A * 1/1909 Rice ..... E01B 29/20 254/43
1,373,598 A * 4/1921 Carman ..... E01B 29/20 254/43
1,919,090 A * 7/1933 Busby ..... E01B 29/20 254/44
2,730,962 A * 1/1956 Wright et al. ..... E01B 29/17 104/16
4,320,708 A * 3/1982 Bommart ..... E01B 29/20 104/15
4,800,817 A 1/1989 Carstensen et al.
5,575,416 A 11/1996 Oellerer et al.
6,385,861 B1 5/2002 Blackwell et al.
6,396,020 B1 5/2002 Thelen et al.
6,651,353 B1 11/2003 Evans et al.
8,684,279 B1 4/2014 Bledsoe

FOREIGN PATENT DOCUMENTS

SU 10024 A1 * 6/1929 ..... E01B 29/46

* cited by examiner

*Primary Examiner* — R. A. Smith
(74) *Attorney, Agent, or Firm* — Armstrong Teasdale LLP

(57) ABSTRACT

A rail alignment tool for aligning a rail segment of a railroad track positioned on a plurality of railroad ties is provided. The rail alignment tool includes a first side member and a second side member. The first side member includes first and second adjustment arms, and a first connecting member between the adjustment arms. The adjustment arms are positioned on opposite sides of a railroad tie. The second side member receives the adjustment arms and includes a second connecting member. At least one of the side members includes a first adjustment member that extends from the first and/or second connecting members in a first direction substantially perpendicular to a longitudinal axis of the rail segment. The adjustment arms engage a bottom surface of the rail segment and move the rail segment away from the railroad tie when the first adjustment member is extended.

28 Claims, 3 Drawing Sheets

RAIL ALIGNMENT TOOL

BACKGROUND

The field of the invention relates generally to railroad tracks and, more specifically, railroad track alignment tools for aligning rail segments for a railroad track.

Railroad tracks typically include a pair of longitudinal rails and a plurality of railroad ties extending perpendicular to the rails. The rails are fastened to the railroad ties using spikes or other fasteners and are configured to facilitate movement of a train along the railroad tracks. The rails are formed from a plurality of rail segments to provide enhanced control of the direction of the rails during installation. These rail segments are positioned in a face-to-face configuration and secured together. For example, the rail segments may be welded to each other.

In at least some known cases, the rail segments are heavy and difficult to align. In one example, workers installing the railroad tracks manually adjust the rails. These workers not only have to coordinate their adjustments, but also maintain these adjustments during installation (i.e., prevent slipping of the rail segments). In some known systems, alignment tools may be employed to align the rail segments. However, these alignment tools typical require the rail segments, spikes, and railroad ties to be separated during installation to facilitate moving the rail segments. For example, at least some known alignment tools require removing the tie plate from the railroad tie to use the alignment tools to align the rail segment. In addition, some alignment tools do not anchor the rail segments to the railroad ties during installation, which may lead to shifting of the rail segments and/or the railroad ties.

BRIEF DESCRIPTION

In one aspect, a rail alignment tool for aligning rail segments of a railroad track positioned on a plurality of railroad ties is provided. The rail segments have a longitudinal axis. The rail alignment tool includes a first side member and a second side member. The first side member includes a first adjustment arm positioned adjacent a first side of a railroad tie, a second adjustment arm positioned adjacent a second side of the railroad tie opposite the first side, and a first connecting member connecting the first adjustment arm to the second adjustment arm. The first adjustment arm and the second adjustment arm extend adjacent a bottom surface of a rail segment. The second side member receives the first adjustment arm and the second adjustment arm. The second side member includes a second connecting member. At least one of the first side member and the second side member includes a first adjustment member that extends from at least one of the first connecting member and the second connecting member in a first direction substantially perpendicular to the longitudinal axis. The first adjustment arm and the second adjustment arm engage the bottom surface of the rail segment and move the rail segment away from the railroad tie when the first adjustment member is extended.

In another aspect, a rail alignment tool for aligning rail segments of a railroad track positioned on a plurality of railroad ties is provided. The rail segments have a longitudinal axis. The rail alignment tool includes a first side member and a second side member. The first side member includes a first adjustment arm that is positioned adjacent a first side of a railroad tie, a second adjustment arm positioned adjacent a second side of the railroad tie opposite the first side, a first adjustment member and a rail alignment member. The rail alignment member moves a rail segment in a first direction that is substantially perpendicular to the longitudinal axis. The rail segment extends adjacent the rail alignment member. The first adjustment member moves the rail alignment member in the first direction to engage the rail segment and move the rail segment in the first direction. The second side member receives the first adjustment arm and the second adjustment arm.

In yet another aspect, a rail alignment tool for aligning rail segments of a railroad track positioned on a plurality of railroad ties is provide. The rail segments have a longitudinal axis. The rail alignment tool includes a first side member and a second side member. The first side member includes a first adjustment arm, a second adjustment arm, a connecting member connecting the first adjustment arm to the second adjustment arm, a first adjustment member and a rail alignment member. The first adjustment member moves the rail alignment member in a first direction that is substantially perpendicular to the longitudinal axis of the rail segment. The second side member includes a first receiving member, a second receiving member and a second connecting member connecting the first receiving member to the second receiving member. The first receiving member receives the first adjustment arm, and the second receiving member receives the second adjustment arm. At least one of the first side member and the second side member include a second adjustment member that extends from at least one of the first connecting member and the second connecting member in a second direction substantially perpendicular to the first direction and the longitudinal axis.

In a further aspect, a method for aligning rail segments of a railroad track with a first rail alignment tool including a first side member and a second side member is provided. The method includes positioning the first side member on a first railroad tie adjacent a first rail segment positioned on a first tie plate, slidably coupling the second side member to the first side member such that the first rail segment and the first tie plate are positioned between the first side member and the second side member, and adjusting at least one of a first adjustment member and a second adjustment member of the first rail alignment tool to cause the first rail alignment tool to engage the first rail segment and move the first rail segment from a first position to a second position.

In another aspect, a rail alignment tool for aligning rail segments of a railroad track positioned on a plurality of railroad ties is provided. The rail alignment tool includes a first side member and a second side member. The first side member includes a first adjustment arm and a second adjustment arm. The second side member receives the first and second adjustment arms. The first and second adjustment arms extend around a tie plate while the tie plate is coupled to a railroad tie of the plurality of railroad ties and move a rail segment relative to the tie plate.

DETAILED DESCRIPTION

The systems and methods described herein are related to a rail alignment tool for aligning rail segments of a railroad track to facilitate coupling adjacent rail segments together. The embodiments described herein include a rail alignment tool that is formed from two opposing side members that are slidably coupled together and positioned on a railroad tie around a tie plate and a rail segment positioned on the tie plate. The first side member includes a pair of adjustment arms that are positioned adjacent opposing sides of the railroad tie. The second side member includes a pair of receiving members that receive the adjustment arms and couple the side members together. The rail alignment tool further includes a first adjustment member and a second adjustment member that cause the rail alignment tool to engage the rail segment and move the rail segment along a first movement axis and a second movement axis, respectively. The first movement axis is substantially perpendicular to the longitudinal axis of the rail segment and the second movement axis is substantially perpendicular to both the first movement axis and the longitudinal axis of the rail segment. In one embodiment, two rail alignment tools are used on adjacent rail segments to position the rail segments in a face-to-face configuration to facilitate welding or otherwise coupling the adjacent rail segments together.

Figure 1:
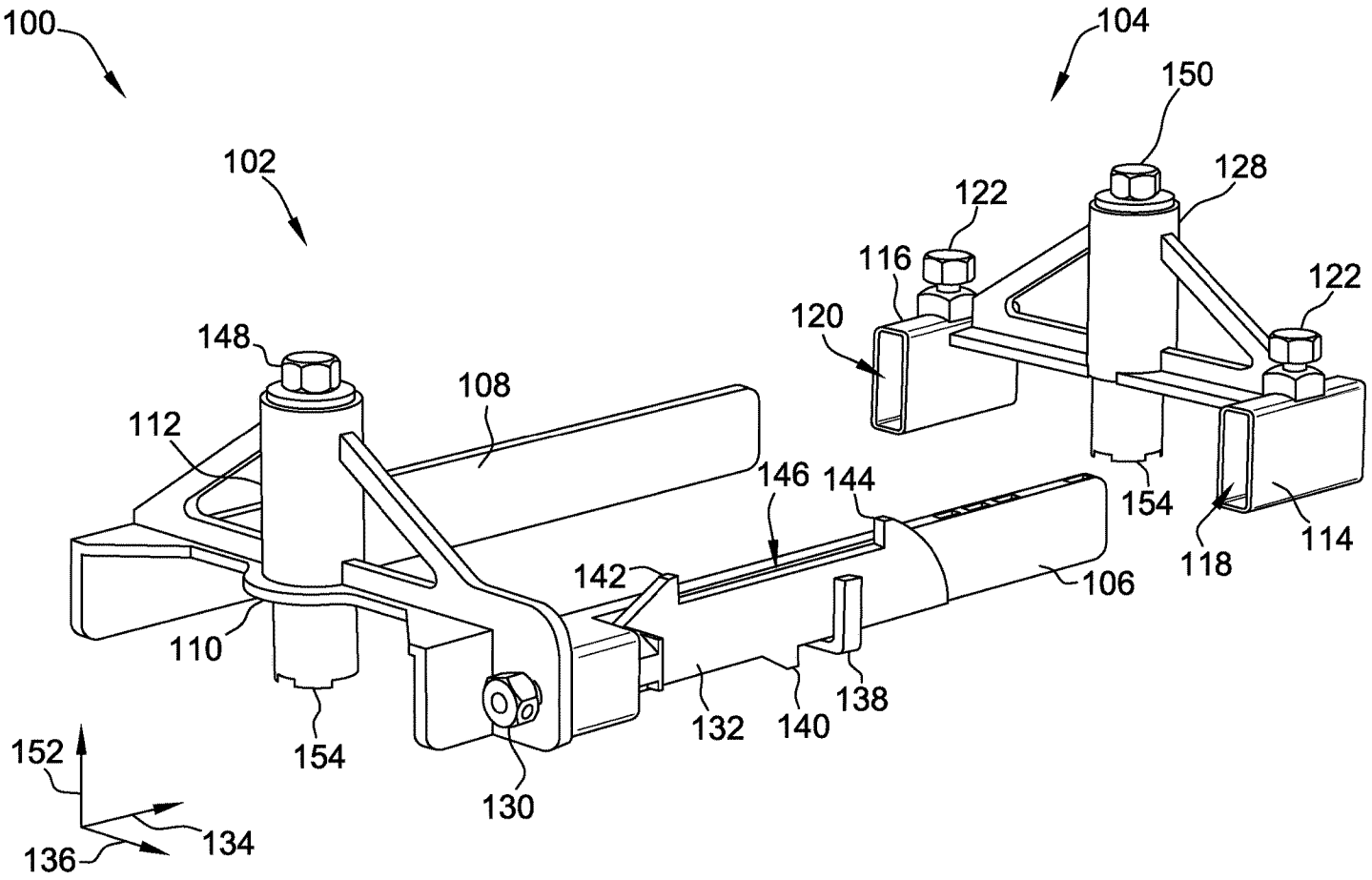
FIG. 1 is a side perspective view of an exemplary rail alignment tool.

FIG. 1 is a side perspective view of an exemplary rail alignment tool 100. Tool 100 includes a first side member 102 and a second side member 104. Tool 100 is configured to be coupled to a rail segment to move or re-position the rail segment during installation or maintenance. In other embodiments, tool 100 may include additional, fewer, or alternative components and functions, including those described elsewhere herein.

In the exemplary embodiment, first side member 102 includes a first adjustment arm 106 and a second adjustment arm 108. Adjustment arms 106, 108 are spaced apart from each other and extend in the same direction to facilitate a railroad tie (not shown in FIG. 1) to be positioned between arms 106, 108. First side member 102 also includes a connecting member 110 that extends between adjustment arms 106, 108 and a sleeve member 112 that extends from connecting member 110.

Second side member 104 includes a first receiving member 114 and a second receiving member 116 that are configured to receive adjustment arms 106, 108, respectively. In the exemplary embodiment, receiving members 114, 116 define a pair of arm openings 118, 120 that are sized to receive arms 106, 108. Receiving members 114, 116 are spaced apart from each other similar to adjustment arms 106, 108. In certain embodiments, adjustment arms 106, 108 include a slot (not shown) that is configured to secure arms 106, 108 to receiving members 114, 116. Receiving members 114, 116 include fasteners 122 that are configured to facilitate coupling between first side member 102 and second side member 104. In at least some embodiments, fasteners 122 are configured to contact adjustment arms 106, 108 when arms 106, 108 are within arm openings 118, 120. Fasteners 122 contact adjustment arms 106, 108 to maintain adjustment arms 106, 108 within arm openings 118, 120 and secure side members 102, 104 together. In one embodiment, adjustment arms 106, 108 include one or more grooves (not shown) configured to receive fasteners 122. In the exemplary embodiment, fasteners 122 are threaded to enable a user to rotate fasteners 122 to adjust a contact force on arms 106, 108. Second side member 104 further includes a connecting member 126 that extends between receiving members 114, 116 and a sleeve member 128 that extends from connecting member 126.

In the exemplary embodiment, first side member 102 further includes a first adjustment member 130 and a rail alignment member 132 coupled to first adjustment member 130. First adjustment member 130 is configured to adjust a position of rail alignment member 132 along a first movement axis 134. When rail alignment tool 100 is properly positioned with respect to the rail segment, first movement axis 134 is substantially perpendicular to a longitudinal axis 136 of a rail segment. In the exemplary embodiment, first adjustment member 130 is a threaded fastener (e.g., a bolt or screw) that, when rotated, causes rail alignment member 132 to move along first movement axis 134. In other embodiments, first adjustment member 130 may be a different component that is configured to control movement of rail alignment member 132 along first movement axis 134.

In on embodiment, rail alignment member 132 is adjacent first adjustment arm 106. First adjustment arm 106 includes a bracket 138 configured to maintain rail alignment member 132 adjacent first adjustment arm 106. In addition, rail alignment member 132 includes a stop member 140 configured to contact bracket 138 to prevent rail alignment member 132 from moving further away from first adjustment member 130. In other embodiments, rail alignment member 132 is in a different position or is integrated with first adjustment arm 106 and/or second adjustment arm 108. In some embodiments, tool 100 includes a plurality of rail alignment members 130.

Rail alignment member 132 also includes a first boundary member 142 and a second boundary member 144 extending away from adjustment arm 106. Boundary members 142, 144 are spaced apart from each other and define an alignment slot 146 sized to maintain a rail segment to extend therewith during alignment. In the exemplary embodiment, adjusting first adjustment member 130 causes boundary members 142, 144 to move along first movement axis 134. Accordingly, when a rail segment is positioned within alignment slot 146 and rail alignment member 132 is moved along first movement axis 134, boundary members 142, 144 engage the rail segment and move the rail segment in the same direction as rail alignment member 132.

In the exemplary embodiment, first side member 102 includes a second adjustment member 148, and second side member 104 includes a second adjustment member 150. In other embodiments, tool 100 may include a different number of second adjustment members (e.g., one second adjustment member). Second adjustment member 148, 150 are configured to extend along a second movement axis 152 and cause at least adjustment arms 106, 108 to move along second movement axis 152. Second movement axis 152 is substantially perpendicular to first movement axis 134 and longitudinal axis 136. In one example, second adjustment member 148, 150 are telescoping members that extend in response to rotating a bolt of second adjustment member 148, 150. In the exemplary embodiment, second adjustment member 148, 150 force tool 100 away from the railroad tie positioned underneath tool 100 when second adjustment members 148, 150 are extended. In particular, connecting members 110, 126 are forced away from the railroad tie by second adjustment member 148, 150, which causes adjustment arms 106, 108 and receiving members 114, 116 to also move away from the railroad tie.

In at least some embodiments, second adjustment member 148, 150 include one or more contacting elements 154 that contact the railroad tie. In the exemplary embodiment, contacting elements 154 are teeth integrally formed on second adjustment member 148, 150. Contacting elements 154 are configured to engage the railroad tie and prevent tool 100 from slipping along the railroad tie in order to maintain a fixed relationship between an initial location of the rail segment on the railroad tie and a second location of the rail segment during alignment.

Figure 2:
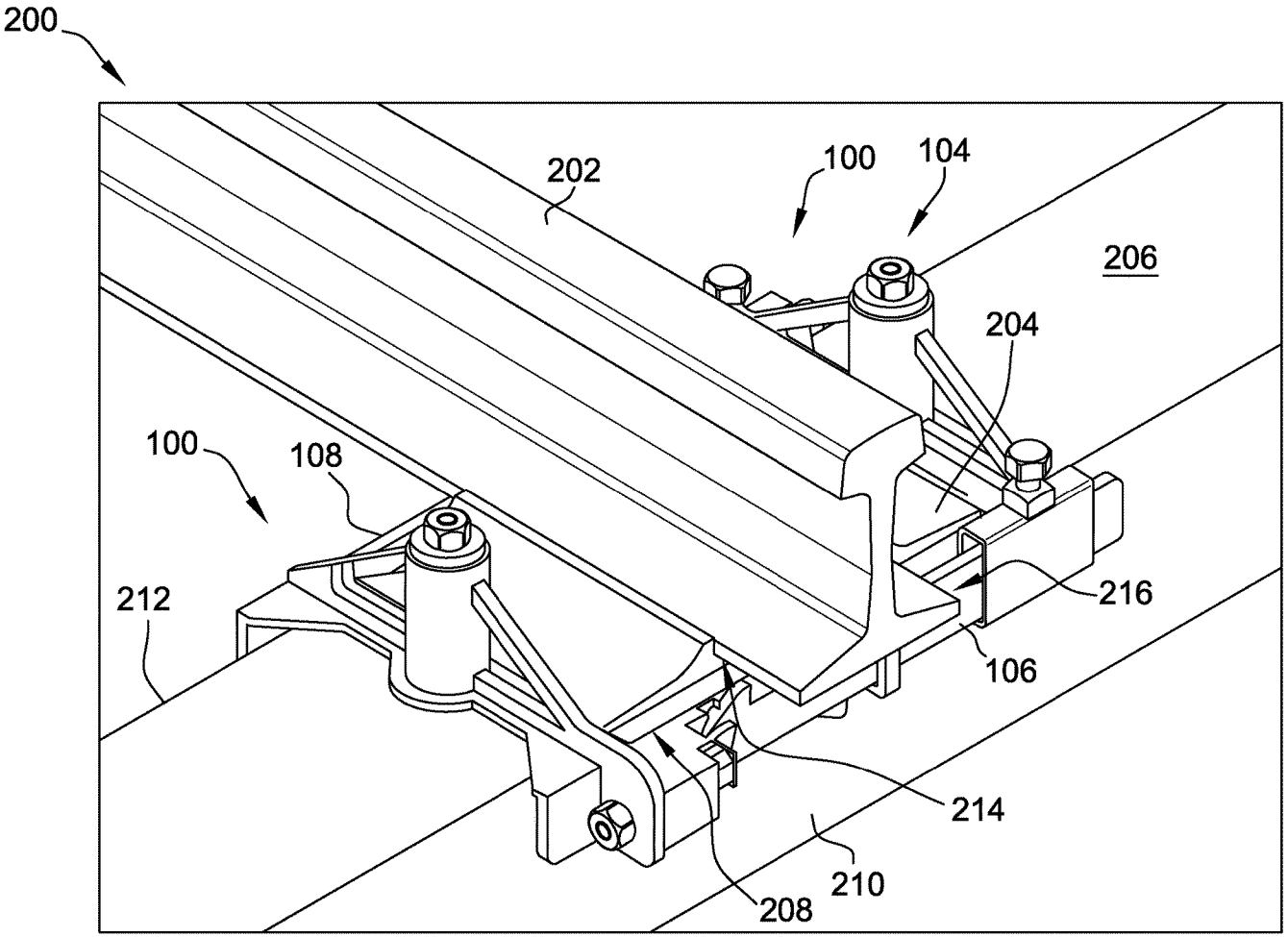
FIG. 2 is a perspective view of the rail alignment tool shown in FIG. 1 with a rail segment during alignment.

FIG. 2 is a perspective view of an exemplary alignment system 200 that includes rail alignment tool 100. In the exemplary embodiment, system 200 further includes a rail segment 202, a tie plate 204, and a railroad tie 206. Rail segment 202 extends perpendicular to railroad tie 206 over a plurality of railroad ties. Tie plate 204 is configured to facilitate coupling rail segment 202 and railroad tie 206 together and provide support for rail segment 202. Although not shown, rail segment 202, tie plate 204, and railroad tie 206 may include one or more fasteners (e.g., spikes) or other means of connection. In one embodiment, rail segment 202 is disconnected from tie plate 204 and railroad tie 206 to align rail segment 202 using tool 100. In such an embodiment, tie plate 204 remains connected to railroad tie 206. That is, tool 100 is configured to align rail segment 202 without requiring tie plate 204 to be removed. In another embodiment, tie plate 204 is disconnected from railroad tie 206.

Tool 100 is configured to be positioned around tie plate 204. In particular, first and second side members 102, 104 are slidably coupled together underneath a bottom surface (not shown) of rail segment 202 and around tie plate 204. First and second side members 102, 104 define a plate opening 208 sized to enable tie plate 204 to be positioned within opening 208. First adjustment arm 106 extends around tie plate 204 adjacent a first side 210 of railroad tie 206, and second adjustment arm 108 extends around tie plate 204 adjacent a second side 212 of railroad tie 206 opposite first side 210. Although tool 100 is not coupled to railroad tie 206 in the exemplary embodiment, the weight of rail segment 202 and contacting elements 154 (shown in FIG. 1) enable tool 100 to remain in a substantially fixed position relative to railroad tie 206 during use thereof.

Adjustment arms 106, 108 extend across the bottom surface of rail segment 202. In one example, adjustment arms 106, 108 extend perpendicular to a longitudinal axis of rail segment 202. In another example, adjustment arms 106, 108 extend at an oblique angle to the longitudinal axis of rail segment 202. In the exemplary embodiment, rail segment 202 is positioned to extend through alignment slot 146.

Once first and second side members are coupled together around tie plate 204, a user adjusts first adjustment member 130 and/or second adjustment members 148, 150 to cause tool 100 to engage rail segment 202 and move rail segment 202 from a first position to a second position for alignment with another rail segment. More specifically, in the exemplary embodiment, adjusting first adjustment member 130 causes rail alignment member 132 to engage rail segment 202 on a first side 214 and/or an opposing second side 216 and move along a substantially lateral axis relative to the longitudinal axis of rail segment 202. Adjusting second adjustment members 148, 150 causes connecting members 110, 126, and subsequently adjustment arms 106, 108, to move along a substantially longitudinal axis perpendicular to the rail longitudinal axis to engage the bottom surface of rail segment 202. In at least some embodiments, tie plate 204 is moved with rail segment 202.

In one example, rail segment 202 is aligned with an adjacent rail segment using a second rail alignment tool 100 connected to the adjacent rail segment. Rail segment 202 may be welded or otherwise coupled to the adjacent rail segment to facilitate a continuous railroad track. Once the rail segments are coupled together, tool 100 is configured to position rail segment 202 in the initial location on tie plate 204 or a different location adjacent to railroad 206. First and second side members 102, 104 are detached from each other and removed from railroad tie 206.

Figure 3:
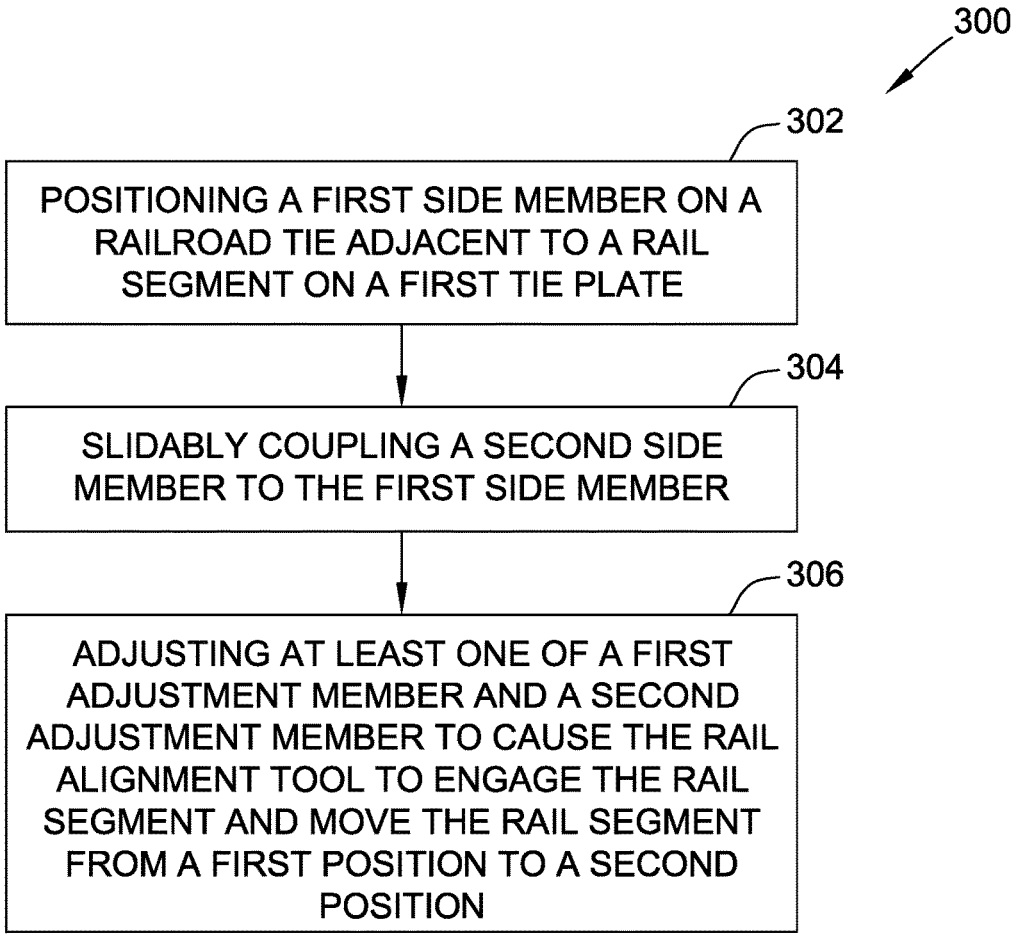
FIG. 3 is a flow diagram of an exemplary method for aligning a rail segment of a railroad track that may be performed by the rail alignment tool shown in FIG. 1.

FIG. 3 is a flow diagram of an exemplary method 300 for aligning a rail segment of railroad track. Method 300 may be used with, for example, alignment system 200 (shown in FIG. 2). In other embodiments, method 300 may include additional, fewer, or alternative steps, including those described elsewhere herein.

With respect to FIGS. 1-3, in the exemplary embodiment, first side member 102 of rail alignment tool 100 is positioned 302 on a railroad tie adjacent rail segment 202 positioned on tie plate 204. Second side member 104 is slidably coupled 304 to first side member 102 such that rail segment 202 and tie plate 204 are positioned between first side member 102 and second side member 104. By extending around tie plate 204, tool 100 is configured to align rail segment 202 while tie plate 204 remains coupled to railroad tie 206. In at least some embodiments, rail alignment tool 100 facilitates reducing the necessary time to align rail segment 202 in comparison to at least some known alignment tools by aligning rail segment 202 without removing tie plate 204.

First adjustment member 130 and/or second adjustment members 148, 150 are adjusted 306 to cause rail alignment tool 100 to engage rail segment 202 and move rail segment 202 from a first position to a second position. In the exemplary embodiment, first adjustment member 130 causes rail segment 202 to move along first movement axis 134 that is substantially perpendicular to longitudinal axis 136 of rail segment 202, and second adjustment members 148, 150 cause rail segment 202 to move along second movement axis 152 that is substantially perpendicular to first movement axis 134 and longitudinal axis 136.

In at least some embodiments, a pair of rail alignment tools 100 are used to align adjacent rail segments 202 in a face-to-face configuration for welding or otherwise coupling together rail segments 202. For example, a second rail alignment tool is positioned on a railroad tie adjacent a second rail segment positioned on a second tie plate. The second rail segment is adjacent rail segment 202. At least one of a first adjustment member and a second adjustment member of the second rail alignment tool is adjusted to move the second rail segment into a substantially face-to-face configuration. That is, one end of the first rail segment is positioned adjacent an end of the second rail segment. Once the adjacent rail segments are aligned, a user may weld or couple the ends of the rail segments together to form a portion of a railroad track.

An exemplary technical effect of the apparatus, systems, and methods described herein includes at least one of: (a) enhanced control of a rail segment during alignment with an adjacent rail segment; (b) reduced number of fasteners removed from a railroad track to facilitate moving a rail segment; (c) the tie plate remains coupled to the railroad tie when the rail alignment tool aligns the rail segment; and (d) no fasteners used to couple the rail alignment tool to a railroad tie.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A rail alignment tool for aligning a rail segment of a railroad track positioned on a plurality of railroad ties, the rail segment having a longitudinal axis, said rail alignment tool comprising:

a first side member comprising a first adjustment arm configured to be positioned adjacent a first side of a railroad tie of the plurality of railroad ties, a second adjustment arm configured to be positioned adjacent a second side of the railroad tie opposite the first side of the railroad tie, and a first connecting member connecting said first adjustment arm to said second adjustment arm, wherein said first adjustment arm and said second adjustment arm are configured to extend adjacent a bottom surface of the rail segment; and a second side member configured to receive said first adjustment arm and said second adjustment arm, said second side member comprising a second connecting member, wherein at least one of said first side member and said second side member comprise a first adjustment member configured to extend from at least one of said first connecting member and said second connecting member in a first direction substantially perpendicular to the longitudinal axis, said first adjustment arm and said second adjustment arm configured to engage the bottom surface of the rail segment and move the rail segment away from the railroad tie when said first adjustment member is extended.

2. The rail alignment tool in accordance with claim 1, wherein said first side member further comprises a rail alignment member defining an alignment slot, the alignment slot configured to maintain the rail segment therewithin, said rail alignment member configured to move in a second direction substantially perpendicular to the first direction and the longitudinal axis.

3. The rail alignment tool in accordance with claim 2, wherein said rail alignment member comprises a first boundary member and a second boundary member, the alignment slot defined between said first boundary member and said second boundary member, said first boundary member configured to engage the rail segment on a first side of the rail segment and said second boundary member configured to engage the rail segment on a second side of the rail segment opposite the first side.

4. The rail alignment tool in accordance with claim 2, wherein said first side member further comprises a first bracket configured to maintain said rail alignment member adjacent said first adjustment arm.

5. The rail alignment tool in accordance with claim 4, wherein said rail alignment member comprises a stop member configured to contact said first bracket when said rail alignment member is moved beyond a predetermined distance in the second direction.

6. The rail alignment tool in accordance with claim 1, wherein said first adjustment member comprises at least one contact element configured to contact a surface of the railroad tie when said second adjustment member is extended.

7. The rail alignment tool in accordance with claim 1, wherein said second side member comprises a first receiving member and a second receiving member, said first and second receiving members each comprise a fastener configured to engage a respective adjustment arm of said first and second adjustment arms to couple said first and second side members together.

8. The rail alignment tool in accordance with claim 1, wherein said first and second adjustment arms are configured to extend around a tie plate while the tie plate is coupled to the railroad tie and move the rail segment relative to the tie plate when the first adjustment member is extended.

9. A rail alignment tool for aligning a rail segment of a railroad track positioned on a plurality of railroad ties, the rail segment having a longitudinal axis, said rail alignment tool comprising:

a first side member comprising a first adjustment arm configured to be positioned adjacent a first side of a railroad tie of the plurality of railroad ties, a second adjustment arm configured to be positioned adjacent a second side of the railroad tie opposite the first side of the railroad tie, a first adjustment member and a rail alignment member configured to move the rail segment in a first direction substantially perpendicular to the longitudinal axis, the rail segment extending adjacent said rail alignment member, said first adjustment member configured to move said rail alignment member in the first direction to engage the rail segment and move the rail segment in the first direction; and a second side member configured to receive said first adjustment arm and said second adjustment arm.

10. The rail alignment tool in accordance with claim 9, wherein at least one of said first side member and said second side member comprise a second adjustment member configured to extend in a second direction substantially perpendicular to the longitudinal axis, wherein said first adjustment arm and said second adjustment arm are configured to engage a bottom surface of the rail segment and move the rail segment away from the railroad tie when said second adjustment member is extended.

11. The rail alignment tool in accordance with claim 10, wherein said second adjustment member comprises at least one contact element configured to contact a surface of the railroad tie when said second adjustment member is extended.

12. The rail alignment tool in accordance with claim 9, wherein said rail alignment member defines an alignment slot configured to maintain the rail segment therewithin.

13. The rail alignment tool in accordance with claim 12, wherein said rail alignment member comprises a first boundary member and a second boundary member, the alignment slot defined between said first boundary member and said second boundary member, said first boundary member configured to engage the rail segment on a first side of the rail segment and said second boundary member configured to engage the rail segment on a second side of the rail segment opposite the first side.

14. The rail alignment tool in accordance with claim 9, wherein said first side member further comprises a bracket configured to maintain said rail alignment member adjacent said first adjustment arm.

15. The rail alignment tool in accordance with claim 14, wherein said rail alignment member comprises a stop member configured to contact said bracket when said rail alignment member is moved beyond a predetermined distance in a second direction substantially perpendicular to the longitudinal axis.

16. The rail alignment tool in accordance with claim 9, wherein said second side member comprises a first receiving member and a second receiving member, said first and second receiving members each comprise a fastener configured to engage a respective adjustment arm of said first and second adjustment arms.

17. The rail alignment tool in accordance with claim 9, wherein said first and second adjustment arms are configured to extend around a tie plate while the tie plate is coupled to the railroad tie and move with the rail segment relative to the tie plate when the first adjustment member is extended.

18. A rail alignment tool for aligning rail segments of a railroad track positioned on a plurality of railroad ties, the rail segments having a longitudinal axis, said rail alignment tool comprising:

a first side member comprising a first adjustment arm, a second adjustment arm, a connecting member connecting the first adjustment arm to the second adjustment arm, a first adjustment member and a rail alignment member, said first adjustment member configured to move said rail alignment member in a first direction that is substantially perpendicular to the longitudinal axis; and a second side member comprising a first receiving member, a second receiving member and a second connecting member connecting the first receiving member to the second receiving member, said first receiving member configured to receive said first adjustment arm, said second receiving member configured to receive said second adjustment arm, wherein at least one of said first side member and said second side member comprise a second adjustment member configured to extend from at least one of said first connecting member and said second connecting member in a second direction substantially perpendicular to the first direction and the longitudinal axis.

19. The rail alignment tool in accordance with claim 18, wherein said rail alignment member extends from said first adjustment arm.

20. The rail alignment tool in accordance with claim 18, wherein said rail alignment member is adjacent said first adjustment arm.

21. The rail alignment tool in accordance with claim 20, wherein said first side member further comprises a bracket configured to maintain said rail alignment member adjacent said first adjustment arm.

22. The rail alignment tool in accordance with claim 21, wherein said rail alignment member comprises a stop member configured to contact said bracket when said rail alignment member is moved beyond a predetermined distance in the first direction.

23. The rail alignment tool in accordance with claim 18, wherein said second adjustment member comprises at least one contact element configured to contact a surface of a railroad tie when said second adjustment member is extended.

24. The rail alignment tool in accordance with claim 18, wherein said second adjustment member comprises a first second adjustment member and a second second adjustment member, wherein said first side member comprises said first second adjustment member, wherein said second side member comprises said second second adjustment member.

25. The rail alignment tool in accordance with claim 18, wherein said first and second receiving members each comprise a fastener configured to engage a respective adjustment arm of said first and second adjustment arms.

26. A method for aligning rail segments of a railroad track with a first rail alignment tool comprising a first side member and a second side member, said method comprising:

positioning the first side member on a first railroad tie adjacent a first rail segment positioned on a first tie plate;

slidably coupling the second side member to the first side member, wherein the first rail segment and the first tie plate are positioned between the first side member and the second side member; and adjusting at least one of a first adjustment member and a second adjustment member of the first rail alignment tool to cause the first rail alignment tool to engage the first rail segment and move the first rail segment from a first position to a second position.

27. The method in accordance with claim 26, further comprising:

positioning a second rail alignment tool on a railroad tie adjacent to a second rail segment positioned on a second tie plate, the second rail segment adjacent the first rail segment;

adjusting at least one of a first adjustment member and a second adjustment member of the second rail alignment tool to cause the second rail alignment tool to engage the second rail segment and move the second rail segment in a substantially face-to-face configuration with the first rail segment; and welding a first end of the first rail segment to a first end of the second rail segment.

28. A rail alignment tool for aligning rail segments of a railroad track positioned on a plurality of railroad ties, said rail alignment tool comprising:

a first side member comprising a first adjustment arm and a second adjustment arm; and a second side member configured to receive said first adjustment arm and said second adjustment arm, wherein said first and second adjustment arms are configured to extend around a tie plate while the tie plate is coupled to a railroad tie of the plurality of railroad ties and move a rail segment relative to the tie plate.

* * * * *